US006528223B1

(12) United States Patent
Wilson et al.

(10) Patent No.: US 6,528,223 B1
(45) Date of Patent: Mar. 4, 2003

(54) MAGENTA-COLORED TONER PARTICLES FOR ELECTROSTATOGRAPHIC IMAGING

(75) Inventors: John C Wilson, Rochester, NY (US); Matthew C Ezenyilimba, Walworth, NY (US); Dinesh Tyagi, Fairport, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/989,800

(22) Filed: Nov. 20, 2001

(51) Int. Cl.[7] ..... G03G 9/09

(52) U.S. Cl. ..... 430/108.21; 430/137.14; 524/83

(58) Field of Search ..... 430/108.21, 107.1, 430/137.14; 524/83; 106/31.45, 31.47, 31.49

(56) References Cited

U.S. PATENT DOCUMENTS 5,580,980 A * 12/1996 Etzbach et al. ..... 544/105

FOREIGN PATENT DOCUMENTS

CA 2106779 11/1992
DE 4217973 A1 * 12/1993 ..... 430/108.21

OTHER PUBLICATIONS

U.S. Patent & Trademark Office English–Language Translation of DE 4217,973 A1 (pub. 12/93), Dec. 1993.*

* cited by examiner

*Primary Examiner*—Janis L. Dote

(57) ABSTRACT

A composition for electrostatographic toner particles includes an organic binder polymer and a dye having the structure

I wherein Z represents a thiazole moiety II

II

15 Claims, No Drawings

MAGENTA-COLORED TONER PARTICLES FOR ELECTROSTATOGRAPHIC IMAGING

FIELD OF THE INVENTION

The present invention relates to electrostatographic toners and, more particularly, to a composition for forming magenta-colored toner particles and to toner particles formed therefrom.

BACKGROUND OF THE INVENTION

When Neptune 525, a magenta-colored dye commercially available from BASF, is employed in an evaporative limited coalescence (ELC) process, dye crystallization occurs during the evaporation of the ethyl acetate used in the process, resulting in the formation of a substantial number of toner particles containing little or no dye.

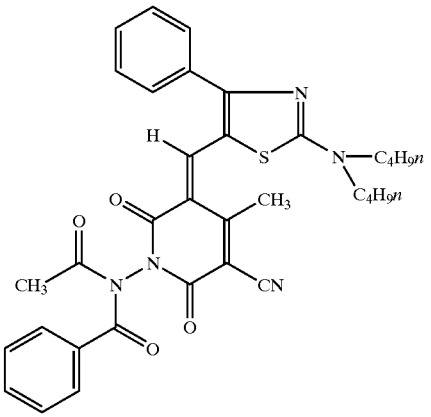

Neptune 525

It is generally recognized that crystallization rates are enhanced by factors such as molecular symmetry and coplanarity that allow for the close packing and alignment of molecules. To eliminate or substantially reduce the tendency towards crystallization exhibited by dyes such as Neptune 525, one might consider variations in dye molecular structure that would hinder molecular packing.

International Patent Application WO 92/19684 and the corresponding Canadian Patent Application No. 2106779, issued to BASF AG, describe N-aminopyridone dyes of formula (I), wherein $R^1$ represents hydrogen or $C_1$–$C_4$ alkyl, $R^2$ and $R^3$ may be identical or different and independently represent hydrogen, optionally substituted $C_1$–$C_{12}$ alkyl, $C_5$–$C_7$ cycloalkyl, optionally substituted phenyl, optionally substituted pyridyl, optionally substituted $C_1$–$C_{12}$ alkanoyl, $C_1$–$C_{12}$ alkoxycarbonyl, optionally substituted $C_1$–$C_{12}$ cycloalkylsulphonyl, optionally substituted phenyl substituted phenylsulphonyl, pyridylsulphonyl, optionally substituted benzoyl, pyridylcarbonyl, or thienylcarbonyl, or $R^2$ and $R^3$ together with the nitrogen atom linking them represent succinimido optionally substituted by $C_1$–$C_4$ alkyl, phthalimido optionally substituted by $C_1$–$C_4$ alkyl, or a five- or six-membered saturated heterocylic residue optionally containing additional heteroatoms, and X represents CH or nitrogen, Y represents cyano or a residue of formula CO—W, CO—OW or CO—NHW, wherein W represents hydrogen, $C_1$–$C_8$ alkyl that is optionally substituted and may be interrupted by one or two oxygen atoms with an ether function, $C_5$–$C_7$ cycloalkyl, phenyl, or tolyl, and Z represents an aromatic carbocyclic or heterocyclic residue.

I

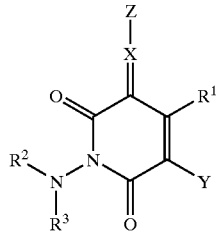

The applications further disclose a process for transferring a pyridone dye from a transfer to plastic-coated paper by diffusion or sublimation with the aid of an energy source.

SUMMARY OF THE INVENTION

The present invention is directed to composition for electrostatographic toner particles that comprises an organic binder polymer and a dye having the structure

I

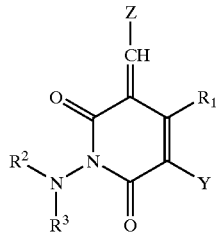

wherein $R^1$ represents hydrogen or an alkyl group containing 1 to about 4 carbon atoms, $R^2$ and $R^3$ each individually represents hydrogen, a substituted or unsubstituted alkyl group containing 1 to about 12 carbon atoms, a cycloalkyl group containing 5 to 7 carbon atoms, a substituted or unsubstituted phenyl group, a substituted or unsubstituted pyridyl group, an alkanoyl group containing 2 to about 12 carbon atoms, an alkoxycarbonyl group containing 2 to about 12 carbon atoms, an alkylsulfonyl group containing 1 to about 12 carbon atoms, a cycloalkylsulfonyl group containing 5 to 7 carbon atoms, a substituted or unsubstituted phenylsulfonyl group, a substituted or unsubstituted pyridylsulfonyl group, a substituted or unsubstituted benzoyl group, a substituted or unsubstituted pyridylcarbonyl group, or a substituted or unsubstituted thienylcarbonyl group; or $R^2$ and $R^3$ together with the nitrogen atom represents a substituted or unsubstituted succinimido group, a substituted or unsubstituted phthalimido group, or a 5- or 6-membered saturated heterocyclic group; Y represents cyano or a residue of formula CO—W, CO—OW or CO—NHW, wherein W represents hydrogen, a substituted or unsubstituted alkyl group containing 1 to about 8 carbon atoms, an alkoxyalkyl group containing up to about 8 carbon atoms, a cycloalkyl group containing 5 to 7 carbon atoms, a substituted or unsubstituted phenyl group; and Z represents a thiazole moiety II

II

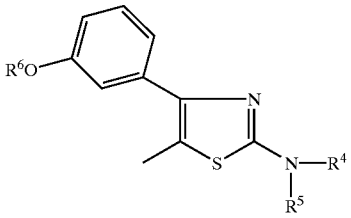

wherein $R^4$ and $R^5$ each individually represents a substituted or unsubstituted alkyl group containing 1 to about 8 carbon atoms, or $R^4$ and $R^5$ taken together with N represent a 5- or 6-membered cyclic ring system, and $R^6$ represents a substituted or unsubstituted alkyl, aryl, alkenyl, or cycloalkyl group containing up to about 10 carbon atoms.

DETAILED DESCRIPTION OF THE INVENTION

In structure I above, $R^1$ preferably represents a methyl group, $R^2$ preferably represents hydrogen, $R^3$ preferably represents a benzoyl group, and Y preferably represents a cyano group.

In structure II above, $R^4$ and $R^5$ can represent the same alkyl group, preferably an n-butyl group. $R^4$ and $R^5$ together with N can also represent a morpholino group, a piperidino group, or a pyrrolidino group. $R^6$ preferably represents an alkyl group, more preferably, a methyl group.

Synthesis Scheme 1 below, a modification of that described in WO 92/19684, was utilized in the preparation of the thiazole N-aminopyridone dyes of the present invention In Scheme 1 as well as in Schemes 2, 3, and 4 that follow, Ar represents, in accordance with the present invention, a phenyl ring substituted at the 3-position with a substituted or unsubstituted alkoxy, alkenoxy, cycloalkoxy, or aryloxy group containing up to about 10 carbon atoms. Preferably, the phenyl 3-substituent is an unsubstituted alkoxy group, more preferably, a methoxy group.

As shown in Scheme 1, the first step is the reaction of an aroyl chloride with potassium thiocyanate, followed by reaction of the resulting product with a secondary amine to form the corresponding thiourea, using the general procedure included in Example 1 of U.S. Pat. No. 4,560,751. The structures of thioureas so prepared are presented in Table 1.

Scheme 1
Synthesis of Thioureas

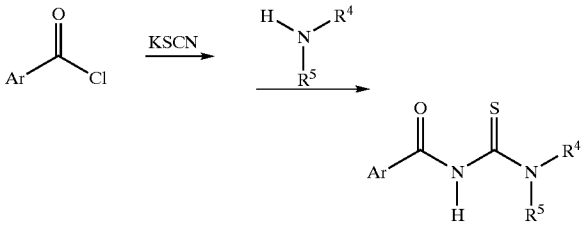

The second step of the synthesis sequence, Scheme 2 below, utilizes the general procedure of Example 1 of U.S. Pat. No. 4,560,751 for the reaction of the thioureas with chloroacetic acid to give the 2-amino-4-arylthiazoles. The structure of the 2-amino-4-arylthiazoles prepared are shown in Table 2.

Scheme 2
Synthesis of 2-Amino-4-arylthiazoles

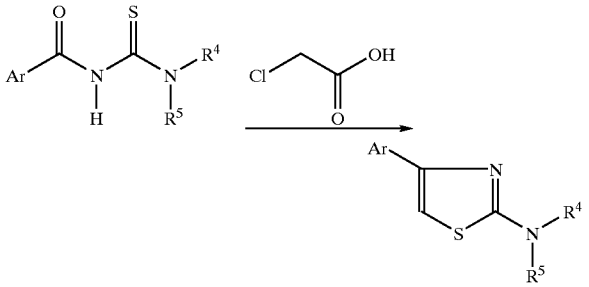

The third step of the reaction sequence, Scheme 3 below, entails formylation of the 2-amino-4-arylthiazoles at the 5-position via the Vilsmeier reaction from phosphorous oxychloride and DMF, following the general procedure reported in *J. Chem. Soc., Perkin Trans. I,* 1983, p.346. The structures of the thiazole aldehydes prepared are shown in Table 3.

Scheme 3
Synthesis of 5-Formyl-2-amino-4-arylthiazoles

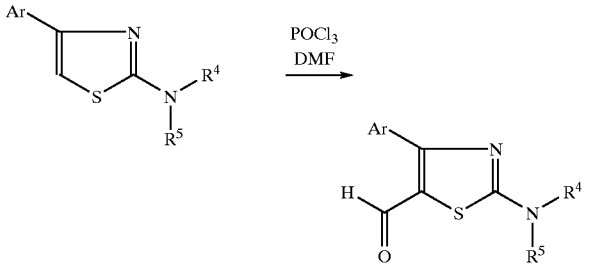

The next step of the reaction sequence, Scheme 4 below, is the acylation of 1-amino-5-cyano-2-hydroxy-4-methyl-6-pyridone, prepared as reported in *Polish Journal of Chemistry,* Vol. 58, 1984, page 85 (CA 123:313975), followed by condensation of the acylated product with a thiazole aldehyde. The general procedure described in WO 92/19684 was used to prepare the pyridone dyes, whose structures are shown in Table 4.

Scheme 4
Synthesis of Pyridone Dyes

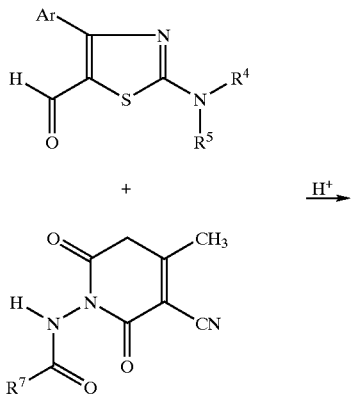

-continued

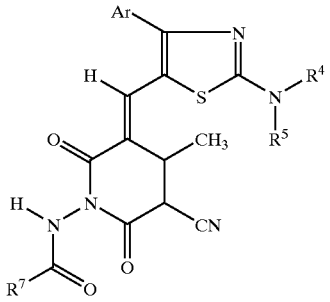

Acylamino-5-cyano-2-hydroxy4-methyl-6-pyridones, in particular, the benzoylamino derivative, can be also prepared by Scheme 5, shown below.

Scheme 5
Synthesis of Potassium 1-amino-5-cyano-2-hydroxy-4-methyl 6-pyridone and 1-Benzoylamino-5-cyano-2-hydroxy-4-methyl-6-pyridone

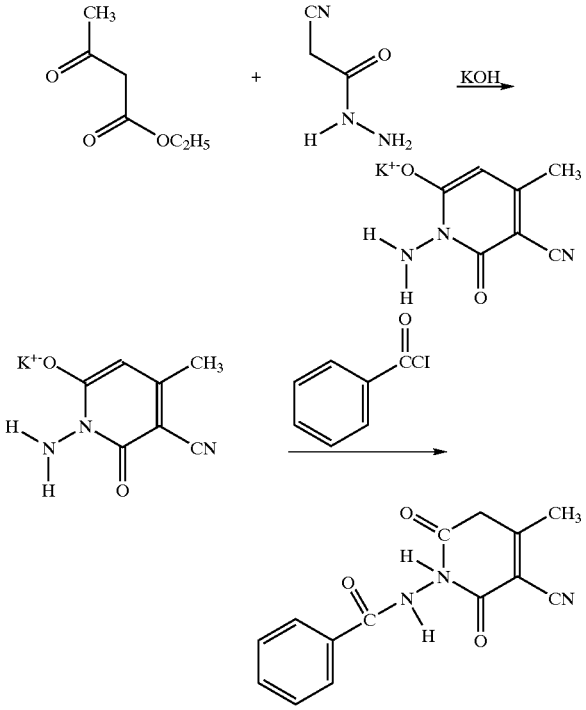

Although not wishing to be bounds by the following interpretation, it is possible that an aromatic substituent such as the phenyl group at the 4-position of the thiazole ring shown in structure III below resides in an extended conjugated coplanar arrangement with the thiazole nucleus. Such an arrangement might be expected to facilitate alignment of molecules in such a way as to result in crystallization of the dye. To avoid this possible tendency towards dye crystallization, various substituents were introduced into the aromatic ring at the thiazolyl 4-position. Substitution of a 3-methoxy group of the phenyl ring, as shown in structure IV below, yielded a dye that did not crystallize when subjected to an evaporative limited coalescence process. Furthermore when this dye was used to make toner particles, all of the particles were colored. It is theorized that a combination of steric effects and hydrogen bonding resulting from the introduction of the 3-methoxy substituent into the phenyl group at the 4-position of the thiazole ring effectively removes the phenyl ring from coplanarity with the conjugated system formed by the thiazolyl ring and the pyridone nucleus.

III

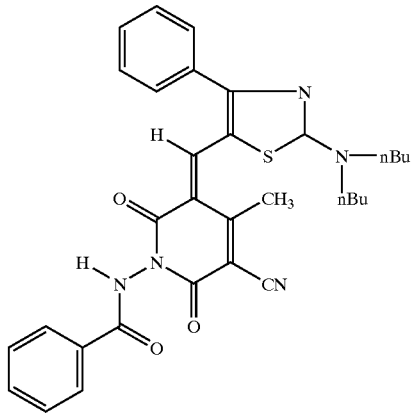

IV

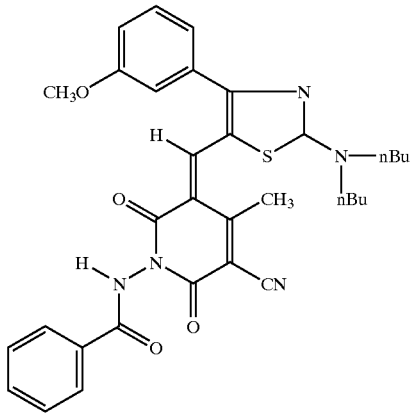

Introduction of a methyl substituent in the 3-position of the phenyl ring on thiazole was not effective in preventing the crystallization of the dye. Similarly, placing the methoxy substituent in the 4-position or introducing methoxy groups into both the 3- and 4-positions were not effective in forestalling dye crystallization. A propyleneoxy substituent in the phenyl 4-position slightly reduced the tendency toward dye crystallization, but other alkyl and alkoxy groups in the 4-position had no significant effect.

In the examples that follow, all melting points are uncorrected. NMR spectra were obtained with a GE QE-300 NMR spectrometer. All chemicals were commercially available unless otherwise indicated.

N,N-Dibutyl-N'-benzoylthiourea (Compound 1-1)

To a solution of 36.93 g (380 mmol) of potassium thiocyanate in 600 ml of acetone was added dropwise over 15 mins, 53.42 g (380 mmol) of benzoyl chloride. The resultant mixture was heated at reflux for 20 mins. To this mixture was added over 10 mins, 51.70 g (400 mmol) of dibutylamine. The mixture was stirred for 3 hrs and poured into a solution of 100 ml of concentrated HCl and 800 ml of ice. The yellow solid precipitate was collected, washed with water and recrystallized from isopropanol. The white solid was collected and dried to give 70.12 g of product (63.1% yield); mp: 90–93° C. The NMR spectrum was consistent with the proposed structure. Anal. Calcd. for $C_{16}H_{24}N_2OS$: C, 65.7; H, 8.3; N, 9.6; S, 11.0. Found: C, 65.84; H, 8.25; N, 9.61; S, 10.7.

N,N-Dibutyl-N'-(3-methoxybenzoyl)thiourea (Compound 1-24)

To a solution of 38.87 g (0.40 mol) of potassium thiocyanate in 630 ml of acetone was added dropwise over 15 min, 68.24 g (0.40 mol) m-anisoyl chloride. The mixture was heated to reflux and maintained at reflux for 20 mins. To this mixture was added 51.7 g (0.40 mol) of dibutylamine over 10 min. The mixture was stirred overnight. The mixture was added to a mixture of 103 ml of conc. HCl in 840 ml of ice water. The oily residue was extracted with methylene chloride, dried over magnesium sulfate and concentrated. The yield of product was 94.62% and was used without further purification. Anal. Calcd. for $C_{17}H_{26}N_2O_2S$: C, 63.3; H, 8.1, N, 8.7; S, 9.9. Found: C, 62.54; H, 8.38; N, 8.66: S, 9.19.

2-Dibutylamino-4-(4-t-butylphenyl)thiazole (Compound 2-2)

To a mixture of 174.15 g (0.50 mol) of N,N-di-n-butyl-N'-(4-t-butylbenzoyl)thiourea (compound 1-2), 44.0 g (1.10 mol) of sodium hydroxide and 500 ml of water was added 56.70 g (0.60 mol) of chloroacetic acid. The mixture was stirred and heated on a steam bath for 22 hrs and cooled. The water phase was decanted from the solid phase, and the solid was washed with water and methanol. Recrystallization of the solid from methanol gave 85.6 g (49.7% yield) of product; mp: 48.5–49.5° C. The NMR spectrum was consistent with the proposed structure. Anal. Calcd. for $C_{21}H_{32}N_2S$: C, 73.20; H, 9.36; N, 8.13; S, 9.30. Found: C, 73.04; H, 9.29; N, 8.02; S, 9.19.

2-Dibutylamino-4-(3-methoxyphenyl)thiazole (Compound 2-12)

A mixture of 114.95 g (356.5 mmol) of N,N-di-n-butyl-N'-(3-methoxybenzoyl)thiourea (compound 1-24), 31.37 g (784.2 mmol) of sodium hydroxide, and 350 ml of water was prepared, to which was added 40.42 g (427.8 mmol) of chloroacetic acid. The mixture was stirred and heated on a steam bath for 23 hrs, then cooled. The mixture was extracted with methylene chloride, and the extracts were washed with water, dried over magnesium sulfate, and concentrated. The oily residue began to crystallize on standing. The yield of thiazole was 100.8 g and was used without further purification.

2-Morpholino-4-phenyl-5-thiazolecarboxaldehyde (Compound 3-3)

To a solution of 24.63 g (100 mmol) of 2-morpholino-4-phenyl-5-thiazole (compound 2-3) in 240 ml of DMF was added dropwise a solution of 17.63 g (115 mmol) of phosphorus oxychloride in 60 ml of DMF over 30 mins. The solution was stirred for 16 hrs, with solid forming during the reaction. The mixture was poured into a solution of 50 g of sodium carbonate in 1.2 l of water. A voluminous precipitate was formed, requiring the addition of more water. The solid was collected, washed with water and methanol, and recrystallized from acetonitrile. The white solid was collected and dried to give 19.59 g (71.4% yield) of product; mp 180.5–181.5° C. The NMR spectrum was consistent with the proposed structure. Anal. Calcd. for $C_{14}H_{14}N_2O_2S$: C, 61.3; H, 5.1; N, 10.2; S, 11.7. Found: C, 61.04; H, 5.14; N, 10.23; S, 11.58.

2-Dibutylamino-4-(3-methoxyphenyl)-5-thiazolecarboxaldehyde (Compound 3-11)

To a solution of 100.8 g (316.5 mmol) of crude 2-di-n-butylamino-4-(3-methoxyphenyl)thiazole (compound 2-12) and 630 ml of DMF was added, over about 30 mins, a solution of 55.81 g (364 mmol) of phosphorus oxychloride in 188 ml of DMF. The mixture was stirred overnight and poured into a solution of 158.1 g of sodium carbonate in 3.5 l of water. The oily precipitate was extracted with methylene chloride, and the extract was washed with water, dried over magnesium sulfate, and concentrated. The yield of brown oil was 88.77 g and was used without further purification. Anal. Calcd. For $C_{19}H_{26}N_2O_2S$: C, 65.9; H, 7.6; N, 8.1; S, 9.3. Found: C, 66.20; H, 7.85; N, 8.60; S, 7.93.

3[2-Dibutylamino-4-(4propoxyphenyl)-5-thiazolidene]-1-benzoylamino-5-cyano-2-hydroxy-4-methyl-6-pyridone (Dye 4-8)

A mixture of 96.50 g (256.6 mmol) of 2-di-n-butylamino-4-(4-propoxyphenyl)-5-thiazolecarboxaldehyde (compound 3-9), 69.19 g (256.6 mmol) of 1-benzoylamino-5-cyano-2-hydroxy-4-methyl-6-pyridone, 2.5 g of p-toluenesulfonic acid monohydrate, and 2 l of toluene was heated at reflux for 19 hrs in a 5-l round bottom flask equipped with a Dean-Stark trap. The hot solution was filtered, and the filtrate was cooled and concentrated to 900 ml. On cooling and standing, a first crop was collected. The filtrate was concentrated to 400 ml, cooled, and allowed to stand. A second crop was collected, washed with P-950 ligroine, and dried. The yield of second crop was 69.26 g (43.14%); Tm (DSC)=223.5° C. The NMR spectrum was consistent with the proposed structure. HPLC analysis of the dye indicated 96.8% purity. Anal. Calcd. for $C_{35}H_{39}N_5O_4S$: C, 67.2; H, 6.3; N, 11.2; S 5.1. Found: C, 67.03; H, 6.12; N, 11.28; S. 4.94.

3-[2-Dibutylamino-4-(3-methoxyphenyl)-5-thiazolidene]-1-benzoylamino-5-cyano-2-hydroxy-4-methyl-6-pyridone (Dye 4-9)

To a solution of 113.0 g (326 mmol) of 2-di-n-butylamino-4-(3-methoxyphenyl)-5-thiazolecarboxaldehyde (compound 3-11) in 2500 ml of ethanol was added 87.3 g (324 mmol) of 1-benzoylamino-5-cyano-2-hydroxy-4-methyl-6-pyridone 3.0 g of p-toluenesulfonic acid monohydrate. The mixture was heated at reflux for 2 hrs, at which time a TLC plate showed no more starting material. The mixture was cooled to 10° C., and a red solid precipitated. The mixture was allowed to stand overnight. 750 ml of ethanol was added to the thick precipitate, and the solid was collected. The solid was dried to give 150 g of crude material, which was dissolved in 750 ml of methylene chloride and passed through a pad of silica gel in a sintered glass funnel. The filtrate was concentrated to about 300 ml and poured into 2 l of P-950 ligroine. The solid was collected, washed with P-950 ligroine, and dried. The yield of product was 142 g (73% yield). HPLC analysis of the dye indicated 99+% purity. Anal. Calcd. for $C_{33}H_{35}N_5O_4S$: C, 66.3; H, 5.9; N, 11.7; S, 5.4. Found: C, 66.5; H, 5.87; N, 11.53; S, 5.19.

Potassium 1-Amino-5-cyano-2-hydroxy-4-methyl-6-pyridone (Scheme 5)

To a mixture of 13.01 g (100 mmol) of ethyl acetoacetate, 9.01 g (100 mmol) of cyanoacetohydrazide, and 150 ml of 3A-ethanol was added a solution of 6.60 g (100 mmol) of 85% KOH in 100 ml of 3A ethanol. The mixture was heated at reflux on a steam bath for 2 hrs, and then cooled. The solid was collected, washed with methanol, and dried. The yield of product was 11.56 g (56.9%). Anal. Calcd. for $C_7H_6N_3O_2K$: C, 41.37; H, 2.98; N, 20.67; K, 19.24. Found: C, 39.86; H, 3.00; N, 20.36; K, 19.2.

1-Benzoylamino-5-cyano-2-hydroxy-4-methyl-6-pyridone (Scheme 5)

To a solution of 10.16 g (50 mmol) of potassium 1-amino-5-cyano-2-hydroxy-4-methyl-6-pyridone in 50 ml of water was added a solution of 7.03 g (50 mmol) of benzoyl chloride in 50 ml of methylene chloride. The mixture was stirred rapidly for 1 hr, and then filtered. The solid was washed with isopropanol and air dried. The yield of product was 3.90 g (29.0%); mp: 256° C. dec. The NMR spectrum was consistent with the proposed structure. Anal. Calcd. for $C_{14}H_{11}N_3O_3$: C, 62.5; H, 4.1; N, 15.6. Found: C, 62.23; H, 4.31; N, 15.85.

TABLE 1
Thioureas
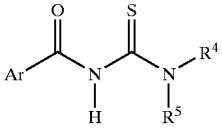
| Compound | Ar | NR4R5 | Yield, % | mp, C |
|---|---|---|---|---|
| 1-1 | 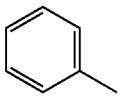 | 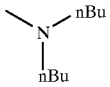 | 63.1 | 90–93 |
| 1-2 | 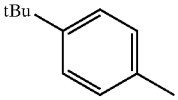 | 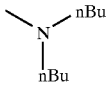 | 32.0 | 62–63 |
| 1-3 | 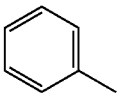 | 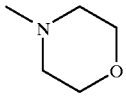 | 57.6 | 141–144 |
| 1-4 | 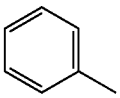 | 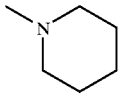 | 37.4 | 117–119 |
| 1-5 | 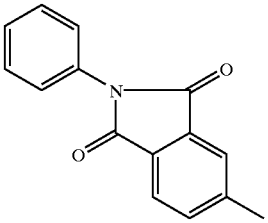 | 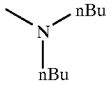 | 74.8 | 136–139 |
| 1-6 | 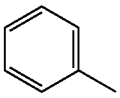 | 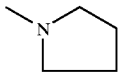 | 25.2 | 108–111.5 |
| 1-7 | 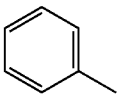 | 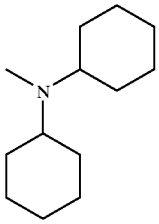 | 89.4 | 115–120 |
| 1-8 | 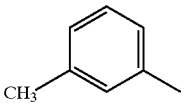 | 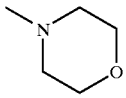 | 69.3 | 140–143 |
| 1-9 | 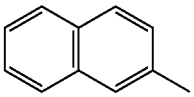 | 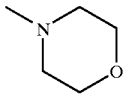 | 71.5 | 160–162.5 |
| 1-10 | 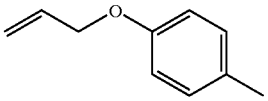 | 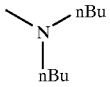 | 85.1 | 49–52 |

TABLE 1-continued
Thioureas
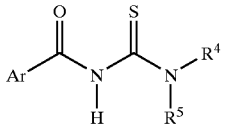
| Compound | Ar | NR4R5 | Yield, % | mp, C |
|---|---|---|---|---|
| 1-11 | 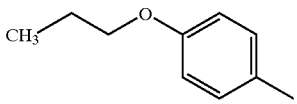 | 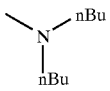 | 88.0 | 43–46 |
| 1-12 | 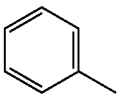 | 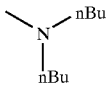 | 25.0 | 89–91 |
| 1-13 | 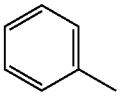 | 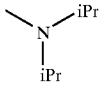 | 97.1 | 91–94 |
| 1-14 | 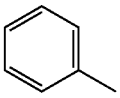 | 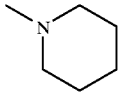 | 47.7 | 115–118 |
| 1-15 | 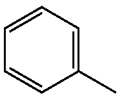 | 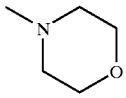 | | 141.5–143 |
| 1-16 | 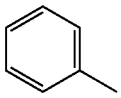 | 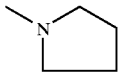 | 29.3 | 123–126 |
| 1-17 | 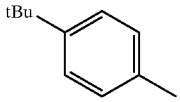 | 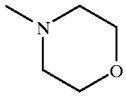 | | 152–154 |
| 1-18 | 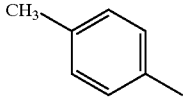 | 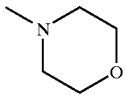 | 73.4 | 142–145 |
| 1-19 | 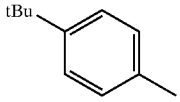 | 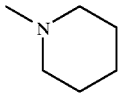 | 58.2 | 160–161.5 |
| 1-20 | 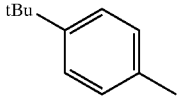 | 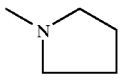 | 33.5 | 131–137 |

TABLE 1-continued
Thioureas
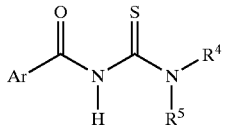
| Compound | Ar | NR4R5 | Yield, % | mp, C |
|---|---|---|---|---|
| 1-21 | 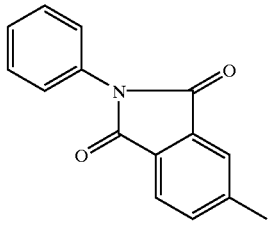 | 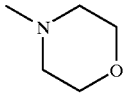 | | 163–165 |
| 1-22 | 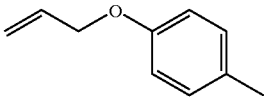 | 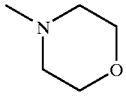 | 78.4 | 148–150.5 |
| 1-23 | 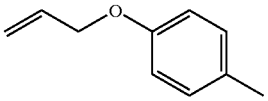 | 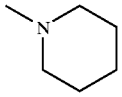 | 61.3 | 82–85.5 |
| 1-24 | 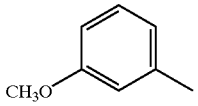 | 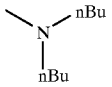 | 94.6 | oil |
| 1-25 | 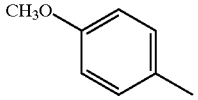 | 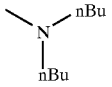 | 81.1 | Tm = 56.08 |
| 1-26 | 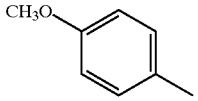 | 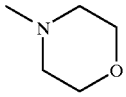 | 80.7 | |
| 1-27 | 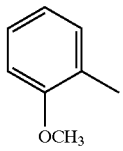 | 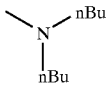 | 78.8 | oil |
| 1-28 | 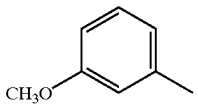 | 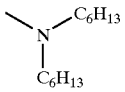 | 73.6 | oil |
| 1-29 | 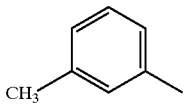 | 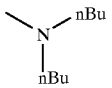 | 85.5 | oil |
| 1-30 | 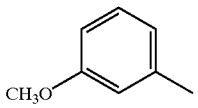 | 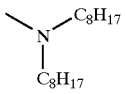 | | Tm = 39.09 |

TABLE 1-continued
Thioureas
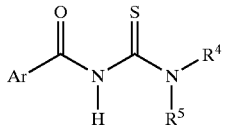
| Compound | Ar | NR4R5 | Yield, % | mp, C |
|---|---|---|---|---|
| 1-31 | 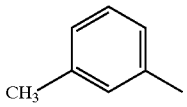 | 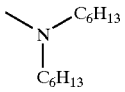 | | oil |
| 1-32 | 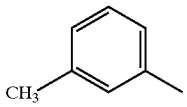 | 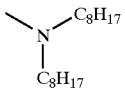 | 71.5 | 53–57 |
| 1-33 | 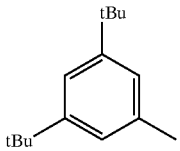 | 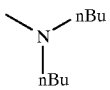 | 75.2 | 106–110 |
| 1-34 | 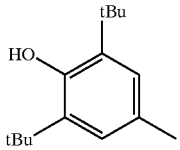 | 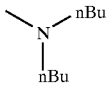 | 23.8 | 139–142 |
| 1-35 | 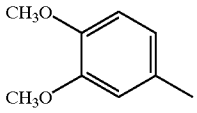 | 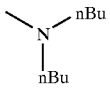 | | oil |
| 1-36 | 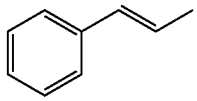 | 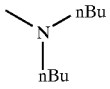 | 79.8 | oil |
TABLE 2
2-Amino-4-arylthiazoles
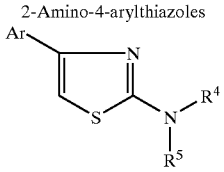
| Compound | Ar | NR4R5 | Yield, % | mp, C |
|---|---|---|---|---|
| 2-1 | 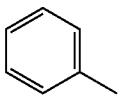 | 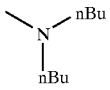 | 61.4 | |
| 2-2 | 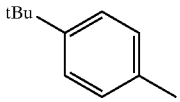 | 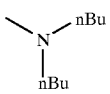 | 49.7 | 48.5–49.5 |

TABLE 2-continued
2-Amino-4-arylthiazoles
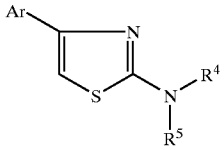
| Compound | Ar | NR4R5 | Yield, % | mp, C |
|---|---|---|---|---|
| 2-3 | 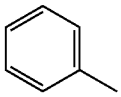 | 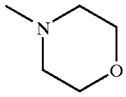 | 37.9 | 71–72 |
| 2-4 | 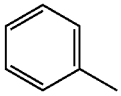 | 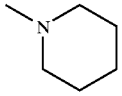 | 47.8 | 72–73 |
| 2-5 | 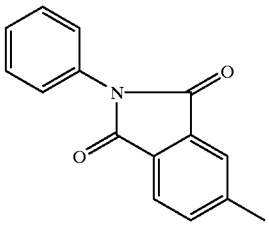 | 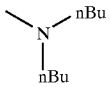 | 12.9 | 131–132 |
| 2-6 | 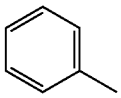 | 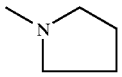 | 53.8 | oil |
| 2-7 | 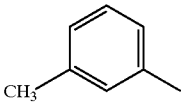 | 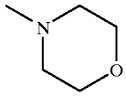 | 38.4 | 67–70 |
| 2-8 | 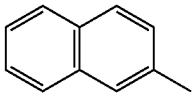 | 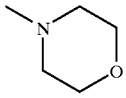 | 20.3 | 131–133 |
| 2-9 | 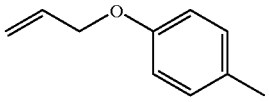 | 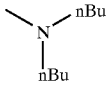 | 77.5 | |
| 2-10 | 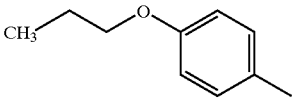 | 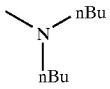 | 88.0 | 43–46 |
| 2-11 | 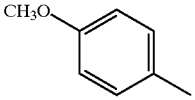 | 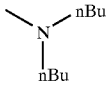 | 87.3 | oil |
| 2-12 | 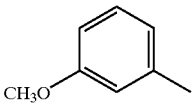 | 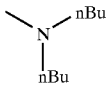 | 88.8 | oil |

TABLE 2-continued
2-Amino-4-arylthiazoles
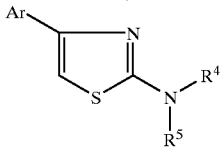
| Compound | Ar | NR4R5 | Yield, % | mp, C |
|---|---|---|---|---|
| 2-13 | 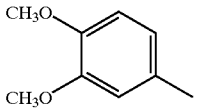 | 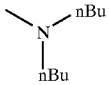 | 78.0 | |
TABLE 3
2-Amino-4-aryl-5-thiazolecarboxaldehydes
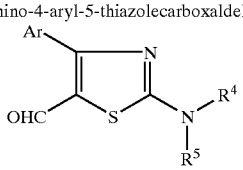
| Ar | NR4R5 | Yield, % | mp, C |
|---|---|---|---|
| 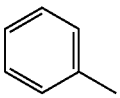 | 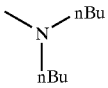 | 45.2 | 43–45 |
| 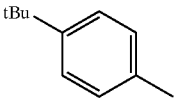 | 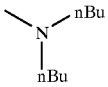 | 44.0 | 114–115 |
| 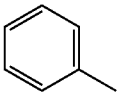 | 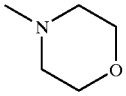 | 71.4 | 180.5–181.5 |
| 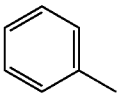 | 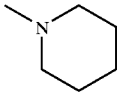 | 60.4 | 109–111 |
| 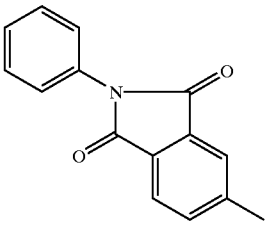 | 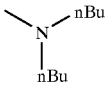 | 12.9 | 131–132 |
| 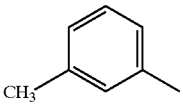 | 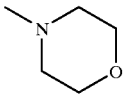 | 59.0 | 160.5–161.5 |
| 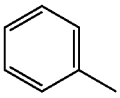 | 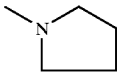 | 57.1 | 124.5–126.5 |

TABLE 3-continued
2-Amino-4-aryl-5-thiazolecarboxaldehydes
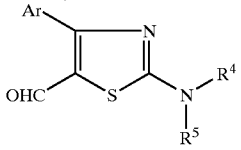
| Ar | NR4R5 | Yield, % | mp, C |
|---|---|---|---|
| 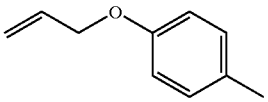 | 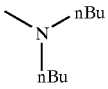 | 90.9 | oil |
| 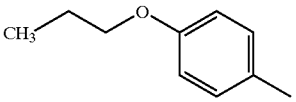 | 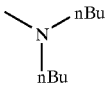 | 85.7 | oil |
| 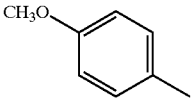 | 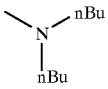 | | |
| 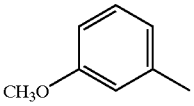 | 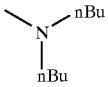 | 80.9 | oil |
| 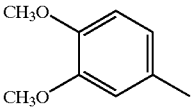 | 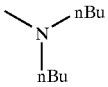 | | |
TABLE 4
Pyridone Magenta Dyes
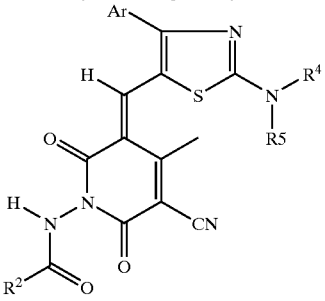
| Dye | Ar | NR4R5 | R7 | Yield, % | λmax, nm (DCM) | mp, C |
|---|---|---|---|---|---|---|
| 4-1 | 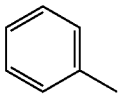 | 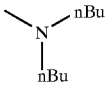 | 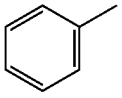 | 54.4 | 538 | 151 (DSC) |
| 4-2 | 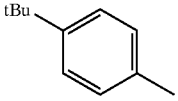 | 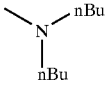 | 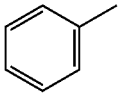 | 16.9 | 540 | 136–150 |
| 4-3 | 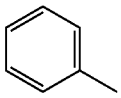 | 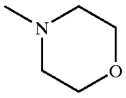 | 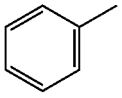 | 70.5 | 534 | 202 (DSC) |

TABLE 4-continued

Pyridone Magenta Dyes

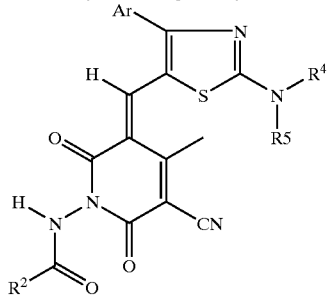

| Dye | Ar | NR4R5 | R7 | Yield, % | λmax, nm (DCM) | mp, C |
|---|---|---|---|---|---|---|
| 4-4 | 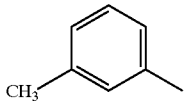 | 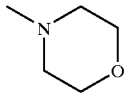 | 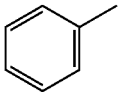 | 65.6 | 534 | 242–244 250 (DSC) |
| 4-5 | 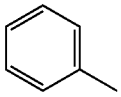 | 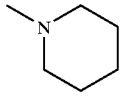 | 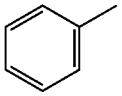 | 58.3 | 538 | 245 (DSC) |
| 4-6 | 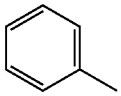 | 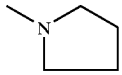 | 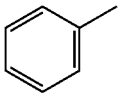 | 62.8 | 534 | |
| 4-7 | 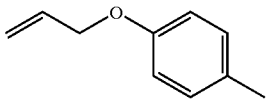 | 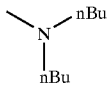 | 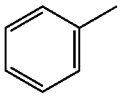 | 39.0 | 542 | |
| 4-8 | 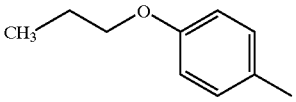 | 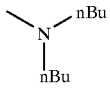 | 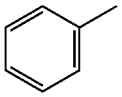 | 43.1 | 542 | 224 (DSC) |
| 4-9 | 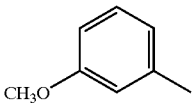 | 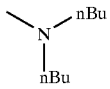 | 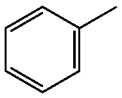 | | 538 | |
| 4-10 | 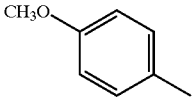 | 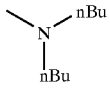 | 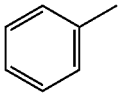 | | 542 | |
| 4-11 | 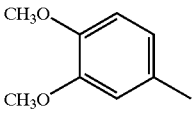 | 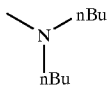 | 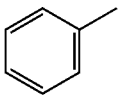 | | 543 | |

The toner particle composition of the present invention includes the dye and binder polymer in a weight ratio preferably of about 1:4 to about 1:50 dye:polymer, more preferably, about 1:10 to about 1:40 dye:polymer. Preferably, the toner particle composition comprises a polyester as the binder polymer, and toner particles are formed from the composition by an evaporative limited coalescence process.

EXAMPLE 1

Invention

To 100.0 g of ethyl acetate was added 24.0 g of KAO C® binder polymer and 1.0 g of Dye 4-9. This mixture, which comprised the organic phase in an evaporative limited coalescence process, was mixed with an aqueous phase comprising 170 ml of pH4 buffer containing 14.0 g of NALCO® 1060 silica and 3.05 ml of a 10 wt. % aqueous solution of poly (adipic acid-co-N-methylaminoethanol). The resulting organic-aqueous mixture was then subjected to very high shear using a POLYTRON® mixer, followed by treatment with a MICROFLUIDIZER® device. Upon exiting, the solvent was removed from the particles so formed by stirring at room temperature overnight in an open container, during which time the organic solvent evaporated. The particles were collected, washed with 0.1N potassium hydroxide solution to remove the silica, then washed with water, and dried. The toner particles were of about 4.2$\mu$ volume average diameter and non-spherical, with the dye dispersed uniformly within the toner particle. Inclusion of this magenta-colored toner is a set of colored toners resulted in a substantial increase in the color gamut relative to that obtained from the baseline color set.

EXAMPLE 2

Comparison

The procedure of Example 1 was repeated, with the exception that dye 4-9 was replaced by Neptune 525 magenta dye. Upon removal of the solvent, the dye crystallized out of the toner particles.

EXAMPLE 3

Comparison

The procedure of Example 1 was repeated, with the exception that dye 4-9 was replaced by Dye 4-1. Upon removal of the solvent, the dye crystallized out of the toner particles.

EXAMPLE 4

Comparison

The procedure of Example 1 was repeated, with the exception that Dye 4-9 was replaced by dye 4-2. Upon removal of the solvent, the dye crystallized out of the toner particles so formed.

EXAMPLE 5

Comparison

The procedure of Example 1 was repeated, with the exception that Dye 4-9 was replaced by Dye 4-7. Upon removal of the solvent, some dye crystallization from the toner particles was observed.

EXAMPLE 6

Comparison

The procedure of Example 1 was repeated, with the exception that Dye 4-9 was replaced by Dye 4-8. Upon removal of the solvent, the dye crystallized out of the toner particles so formed.

EXAMPLE 7

Comparison

The procedure of Example 1 was repeated, with the exception that dye 4-9 was replaced by Dye 4-10. Upon removal of the solvent, the dye crystallized out of the toner particles.

EXAMPLE 8

Comparison

The procedure of Example 1 was repeated, with the exception that Dye 4-9 was replaced by Dye 4-11. Upon removal of the solvent, the dye crystallized out of the toner particles.

EXAMPLE 9

Comparison

The procedure of Example 1 was repeated, with the exception that Dye 4-9 was replaced by Dye 4-3. Upon removal of the solvent, the dye crystallized out of the toner particles.

EXAMPLE 10

Comparison

The procedure of Example 1 was repeated, with the exception that Dye 4-9 was replaced by Dye 4-4. Upon removal of the solvent, the dye crystallized out of the toner particles.

EXAMPLE 11

Comparison

The procedure of Example 1 was repeated, with the exception that Dye 4-9 was replaced by Dye 4-5. Upon removal of the solvent, the dye crystallized out of the toner particles.

EXAMPLE 12

Comparison

The procedure of Example 1 was repeated, with the exception that Dye 4-9 was replaced by Dye 4-6. Upon removal of the solvent, the dye crystallized out of the toner particles.

Dyes prepared in accordance with the present invention can be advantageously employed in the preparation of toners by an evaporative limited coalescence (ELC) process. The dyes so prepared show little tendency to crystallize and maintain the chroma and hue angle. In addition to their usefulness for preparing toners, they can also be employed as colorants in other marking materials such as thermal media, inks, and the like. They are especially useful as magenta colorants in any subtractive primary colorant system based on a cyan, yellow, and magenta (CYM) process. They are also useful in processes where subtractive primary color marking particles are used along with one or more colorants selected from the group consisting of black, orange, violet, and green.

The invention has been described in detail with particular reference to certain preferred embodiments thereof, but it is understood that variations and modifications can be effected within the spirit and scope of the invention, which is defined by the claims that follow.

What is claimed:

1. An electrostatographic toner particle composition comprising an organic binder polymer and a dye having the structure

I

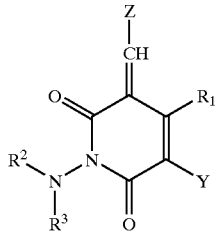

wherein $R^1$ represents hydrogen or an alkyl group containing 1 to about 4 carbon atoms, $R^2$ and $R^3$ each individually represents hydrogen, a substituted or unsubstituted alkyl group containing 1 to about 12 carbon atoms, a cycloalkyl group containing 5 to 7 carbon atoms, a substituted or unsubstituted phenyl group, a substituted or unsubstituted pyridyl group, an alkanoyl group containing 2 to about 12 carbon atoms, an alkoxycarbonyl group containing 2 to about 12 carbon atoms, an alkylsulfonyl group containing 1 to about 12 carbon atoms, a cycloalkylsulfonyl group containing 5 to 7 carbon atoms, a substituted or unsubstituted phenylsulfonyl group, a substituted or unsubstituted pyridylsulfonyl group, a substituted or unsubstituted benzoyl group, a substituted or unsubstituted pyridylcarbonyl group, or a substituted or unsubstituted thienylcarbonyl group; or $R^2$ and $R^3$ together with the nitrogen atom represents a substituted or unsubstituted succinimido group, a substituted or unsubstituted phthalimido group, or a 5- or 6-membered saturated heterocyclic group; Y represents cyano group or a residue of formula CO—W, CO—OW or CO—NHW, wherein W represents hydrogen, a substituted or unsubstituted alkyl group containing 1 to about 8 carbon atoms, an alkoxyalkyl group containing up to about 8 carbon atoms, a cycloalkyl group containing 5 to 7 carbon atoms, a substituted or unsubstituted phenyl group; and Z represents a thiazole moiety II

II

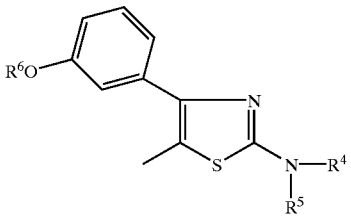

wherein $R^4$ and $R^5$ each individually represents a substituted or unsubstituted alkyl group containing 1 to about 8 carbon atoms, or $R^4$ and $R^5$ taken together with N represent a 5- or 6-membered cyclic ring system, and $R^6$ represents a substituted or unsubstituted alkyl, aryl, alkenyl, or cycloalkyl group containing up to about 10 carbon atoms.

2. The toner particle composition of claim 1 wherein $R^1$ represents a methyl group.

3. The toner particle composition of claim 1 wherein $R^2$ represents hydrogen and $R^3$ represents a benzoyl group.

4. The toner particle composition of claim 1 wherein Y represents a cyano group.

5. The toner particle composition of claim 1 wherein $R^4$ and $R^5$ each represents the same unsubstituted alkyl group.

6. The toner particle composition of claim 5 wherein $R^4$ and $R^5$ each represents an n-butyl group.

7. The toner particle composition of claim 1 wherein $R^4$ and $R^5$ taken together with N represent a morpholino group, a piperidino group, or a pyrrolidino group.

8. The toner particle composition of claim 1 wherein $R^6$ represents an alkyl group.

9. The toner particle composition of claim 8 wherein $R^6$ represents a methyl group.

10. The toner particle composition of claim 1 wherein the dye has the structure

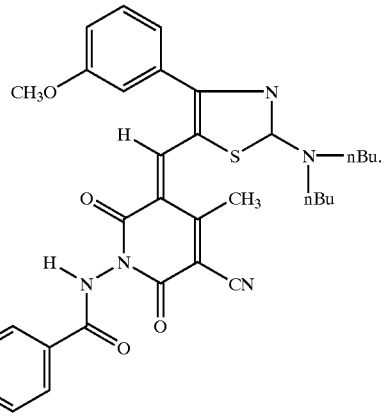

11. The toner particle composition of claim 1 containing the dye and the binder polymer in a weight ratio of about 1:4 to about 1:50 dye:polymer.

12. The toner particle composition of claim 11 containing the dye and the binder polymer in a weight ratio of about 1:10 to about 1:40 dye:polymer.

13. The toner particle composition of claim 1 wherein the binder polymer comprises a polyester.

14. Toner particles formed from the composition of claim 1.

15. Toner particles of claim 14 formed by an evaporative limited coalescence process.

* * * * *